United States Patent [19]

Winkler et al.

[11] Patent Number: 4,753,156

[45] Date of Patent: Jun. 28, 1988

[54] ARMOR CAR-MOUNTED MORTAR

[75] Inventors: Gert Winkler, Meerbusch; Wilfried Becker, Dusseldorf; Erich Zielinski, Haan, all of Fed. Rep. of Germany

[73] Assignee: Rheinmetall GmbH, Düsseldorf, Fed. Rep. of Germany

[21] Appl. No.: 788,734

[22] Filed: Oct. 17, 1985

Related U.S. Application Data

[60] Continuation-in-part of Ser. No. 683,561, Dec. 19, 1984, abandoned, which is a division of Ser. No. 385,007, Jun. 3, 1982, Pat. No. 4,495,852.

[30] Foreign Application Priority Data

Jun. 3, 1981 [DE] Fed. Rep. of Germany ..... 3121999
Jun. 3, 1981 [DE] Fed. Rep. of Germany ..... 3121998

[51] Int. Cl.[4] ..... F41F 23/10

[52] U.S. Cl. ..... 89/40.02; 89/25; 89/36.08; 89/37.05

[58] Field of Search ..... 89/1.35, 25, 37.05, 89/37.12, 37.13, 40.03, 17, 33.03, 36.08, 36.09, 38, 40.02, 37.05

[56] References Cited

U.S. PATENT DOCUMENTS

| | | | |
|---|---|---|---|
| 2,197,816 | 4/1940 | Tate | 89/40.03 |
| 2,788,713 | 4/1957 | Even | 89/40.03 |
| 2,818,781 | 1/1958 | Ruf | 89/40.02 |
| 2,922,338 | 6/1960 | Barbe | 89/1.3 |

FOREIGN PATENT DOCUMENTS

| | | | |
|---|---|---|---|
| 73513 | of 1944 | Czechoslovakia | 89/25 |
| 148739 | 7/1985 | European Pat. Off. | 89/37.05 |
| 1578210 | 3/1972 | Fed. Rep. of Germany | 89/37.05 |
| 2251846 | 5/1972 | Fed. Rep. of Germany | 89/37.05 |
| 1253495 | 1/1961 | France . | |

*Primary Examiner*—Donald P. Walsh
*Assistant Examiner*—Michael J. Carone
*Attorney, Agent, or Firm*—Spencer & Frank

[57] ABSTRACT

A weapons system including a mortar and a vehicle. The vehicle has a body including a side wall having an opening and a region constructed for receiving the mortar. The mortar includes a dividable tube having a lower tube section and a mechanism for pivotally mounting the lower tube section for movement about an essentially horizontal axis to a loading position in which it is aligned with the opening in the side wall for breech loading of the mortar. A mounting device is connected with the vehicle for mounting the mortar for movement between a traveling position in which the mortar is positioned to travel with the vehicle and a firing position in which the mortar is positioned to fire a projectile. The traveling position is delimited by the region provided in the side wall for receiving the mortar and the firing position is located on the ground in the vicinity of the vehicle.

12 Claims, 3 Drawing Sheets

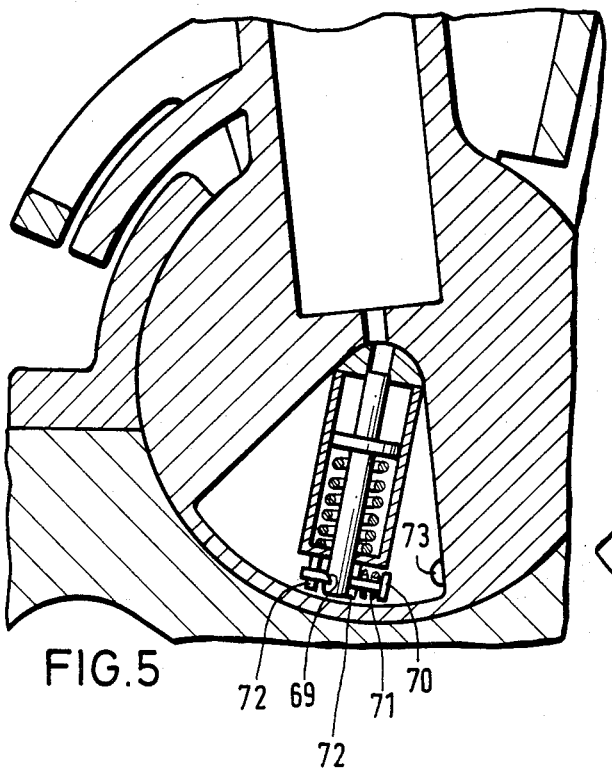
FIG.5
FIG.7
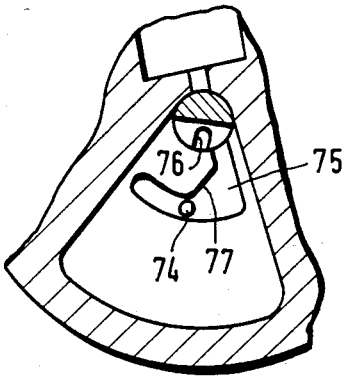
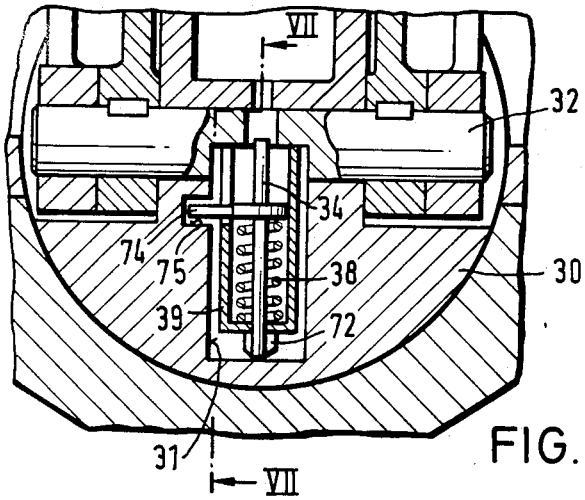
FIG.6
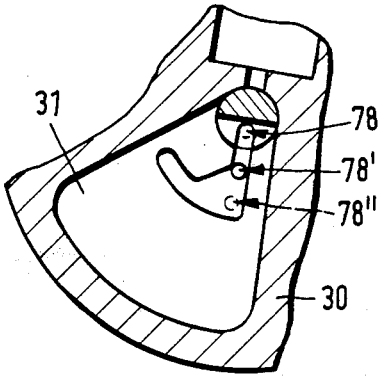
FIG.8

ARMOR CAR-MOUNTED MORTAR

BACKGROUND OF THE INVENTION

The present invention relates to a weapons system including a mortar fastened to the rear end of a vehicle, such as an armored vehicle, the mortar being lowerable by means of a lifting device fastened at the rear wall of the vehicle from a traveling position to a firing position on the ground in the vicinity of the vehicle, with the mortar in the firing position being mounted in a ball joint which is connected with a bottom plate, the system further including devices operable from the vehicle interior for making lateral and elevational adjustments.

Such a weapons system is disclosed in U.S. Pat. No. 2,818,781 where a mortar is mounted at the lower rear end of the interior of an armored vehicle, the breech of the mortar, in the travelling position, being mounted in a ball joint which is disposed on a lowerable platform and the frontal region of the mortar tube being mounted on two adjustable support arms. To lower the platform to the ground, two hydraulically operated telescopic carries are required. During the lowering process, the adjustable supports must be shifted backwards on rails disposed in the interior of the vehicle. The drawbacks of this arrangement are that an additional hydraulic assembly is required for raising and lowering the mortar, the crew is not protected during loading and the weapons systems requires a large amount of space in the vehicle. Moreover, steering in the lateral and elevational direction is complicated and time consuming because, for example, for lateral adjustment of the mortar, both support arms must be adjusted differently but simultaneously.

SUMMARY OF THE INVENTION

It is an object of the present invention to provide a weapons system of the above-mentioned type in which the change from the traveling position into the firing position in the immediate vicinity of the vehicle and vice versa can be accomplished quickly and safely and loading of the ammunition units, as well as elevation and lateral adjustments of the mortar, are easily possible for the crew from a protected position.

The above and other objects are accomplished according to the invention by the provision of a weapons system including:

(a) a vehicle having a body including a side wall provided with a lower recess and defining an overhang with respect to the lower recess;

(b) first and second wall portions attached to the body and defining an opening in the region of the lower recess, the opening being covered by the overhang to provide a covered loading passage for ammunition units;

(c) a mortar including an upper tube portion disposed outside the side wall, a lower tube portion having a lower region and a ball joint with a cut-out section disposed at the lower region, a plate containing a socket for receiving a ball joint, the ball joint being mounted in the ball socket for allowing the lower tube portion to be pivoted, axis means defining a horizontal axis pivotally mounted in the cut-out section of the ball joint, bearings disposed on both sides of the lower tube portion, a housing for at least partially enclosing the lower tube portion in a firing position of the lower tube portion and having one end connected to the upper tube portion and another end connected, within the ball joint and via the bearings, with the axis means;

(d) a lifting carriage including first and second members each being disposed at a respective one of the first and second wall portions and having pivot bearings fastened to the axis means, the first and second members defining a path which is disposed in the opening and which is slightly inwardly inclined with respect to the vehicle for guiding movement of the lower tube portion through the opening;

(e) lifting means drivingly coupled to the carriage at the first wall portion for raising the mortar to a traveling position with respect to said vehicle and for lowering the mortar to a firing position with the plate resting on the ground in the vicinity of the vehicle;

(f) lateral adjusting means disposed at the second wall portion for engaging the second member of the lifting means for laterally adjusting the mortar, the lateral adjusting means being operable from within the vehicle;

(g) pivoting means including a first ring gear fixed to the lower tube portion, a first drive pinion operatively engaged with the first ring gear, and a first shaft mounted to the lifting carriage, drivingly connected to the first drive pinion and controllable from the interior of the vehicle for pivoting the lower tube portion between a loading position in which the lower tube portion is aligned with the opening for receiving an ammunition unit therethrough and a firing position in which the lower tube portion is aligned with the upper tube portion;

(h) elevation adjusting means including a second ring gear fixed to the housing, a second drive pinion operatively engaged with the second ring gear, and a second shaft mounted to the lifting carriage, drivingly connected to the second drive pinion and controllable from the interior of the vehicle for adjusting the elevation of the upper tube portion; and (i) firing means contained within the ball joint and including a firing pin and a tensioning means operatively connected with the firing pin, the tensioning means being responsive to a pivoting of the lower tube portion into the loading position for automatically being placed into a state of tension and responsive to a pivoting of the lower tube portion into the firing position for releasing the state of tension and urging the tensioning means against the firing pin.

The invention will be described in greater detail below with reference to an embodiment which is illustrated in the drawings.

BRIEF DESCRIPTION OF THE DRAWINGS

FIG. 5 is an enlarged sectional view of the tensioning device for the firing pin shown within the ball joint of FIG. 1.

FIG. 6 is an enlarged sectional view of the tensioning device for the firing pin shown within the ball joint of FIG. 2.

FIG. 7 is a sectional view seen along line VII—VII of FIG. 6 showing the swivel breech pivoted into the loading position.

FIG. 8 is a sectional view seen along the line indicated in FIG. 6 with the swivel breech pivoted into the firing position.

DESCRIPTION OF THE PREFERRED EMBODIMENTS

Figure 1:
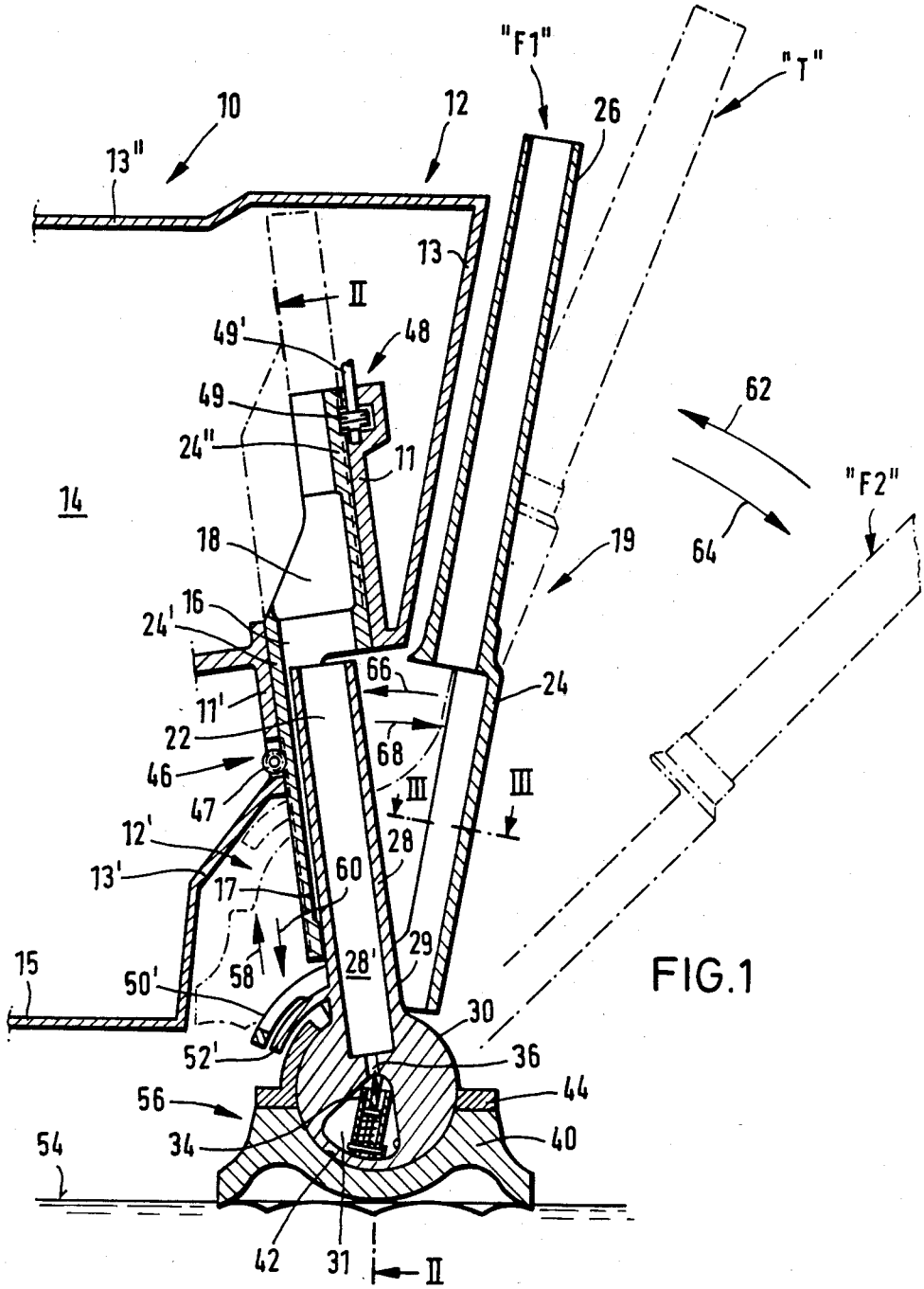
FIG. 1 is a vertical sectional view along the bore axis of a mortar and a rear portion of a vehicle in accordance with the invention.
Figure 2:
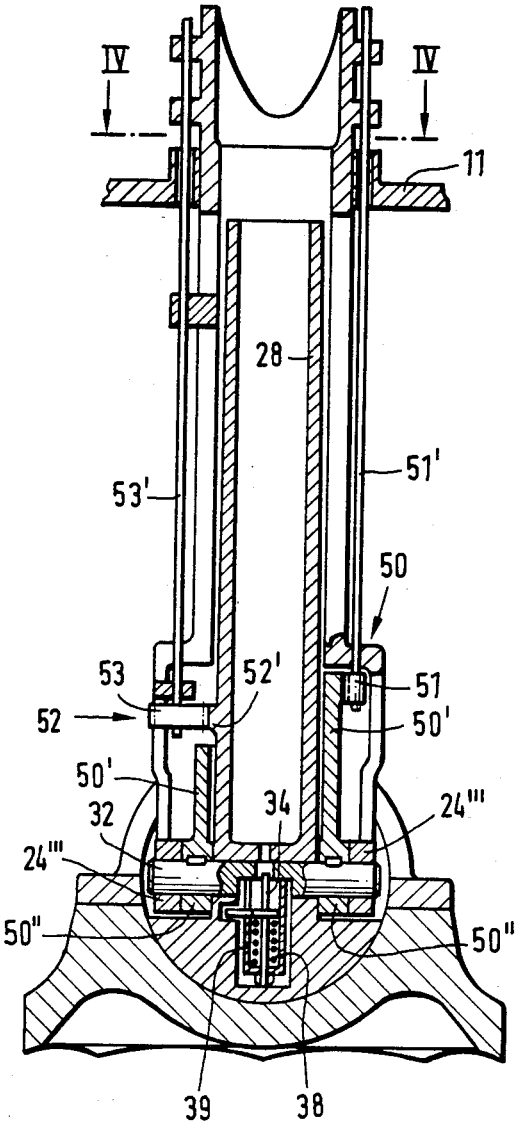
FIG. 2 is a sectional view seen along line II—II of FIG. 1.

Referring to FIGS. 1 and 2, an armored vehicle 10 is provided at its rear with an overhang 12 which is defined on the exterior by an upper rear side wall 13 and at the underside by a lower rear side wall 13' which changes into the vehicle bottom 15. A recess 12' is formed which can be brought into a communicating connection with the interior 14 via an opening 16. The opening 16 is defined by a rear wall 11 and a front wall 11' parallel thereto. A path 18 parallel to walls 11 and 11' and in the central plane of opening 16 is slightly inclined with respect to the vehicle 10 and forms an angle of approximately 80° with the plane of the bottom surface 54. A mortar 19 having a housing 24 is provided with a two-part tube having an upper tube section 26 and a lower tube section 28. The latter is arranged to be pivotal with respect to the upper tube section 26 about a shaft 32 defining an axis 32'. The shaft 32 traverses a ball joint 30 at the lower end 29 of the tube section 28. Through a cover 44, the ball joint 30 is mounted in a ball socket 42 in a bottom plate 40.

In a recess 31 in the ball joint 30 there is disposed a firing pin 34 equipped with a firing pin spring 38 and a tensioning device 39 for cooperating with the firing pin spring 38 as described below. A bore 36 provides a passage into the interior 28' of the lower tube section 28 for the firing pin 34.

The housing 24 of the mortar 19 is provided with a first rear section 24' and a second rear section 24''. Both housing sections 24' and 24'' are designed to serve as a lifting carriage for the mortar. Section 24' is connected, via a toothed strip 17, with a device 46 disposed at the wall 11' for raising and lowering the mortar 19. For the sake of clarity, only the pinion 47 of this device 46 is shown. Section 24'' is connected with a traversing device 48 disposed at the wall 11, of which, for reasons of clarity, only a pinion 49 driven via a shaft 49' is shown.

The mortar 19 is shown in its traveling position in a dot-dash illustration marked with the letter "T". From this position, it can be lowered by means of device 46 in the direction of arrow 60 into the firing position in which it is shown in solid lines. The bottom plate 40 then rests on the bottom surface 54 and occupies a region 56 thereon which is at least in part covered by the overhang 12 at the tail of the vehicle 10.

An elevation adjustment device 50 (FIG. 2) and its drive pinion 51 as well as a member 50' in form-locking connection therewith are shown in the region near the bottom of housing 24. Member 50' is fastened to housing 24 and thus moves as if part of the upper tube section 26 and, on the side of drive pinion 51 (FIG. 2), member 50' is designed as a ring gear. In the region of shaft 32, member 50' is designed as a form-locking bearing 50'' disposed on both sides of lower tube section 28. Rear housing sections 24' and 24'' serve as a lifting carriage and have pivot bearings 24''' which are fastened to the exterior of shaft 32 within a cut-out section of ball joint 30. At the rear end 29 of the lower tube section 28, a pivoting device 52 for the tube section 28, the latter constituting a swivel breech, is connected with a drive pinion 53 and with a ring gear 52' form-lockingly connected therewith.

Drive pinion 51 of elevation adjustment device 50 is driven by means of a shaft 51' mounted in the lifting carriage and extending into the interior 14 of vehicle 10. A shaft 53' for drive pinion 53 of pivoting device 52 is also mounted in the lifting carriage and likewise extends into the interior 14 of vehicle 10.

Figure 3:
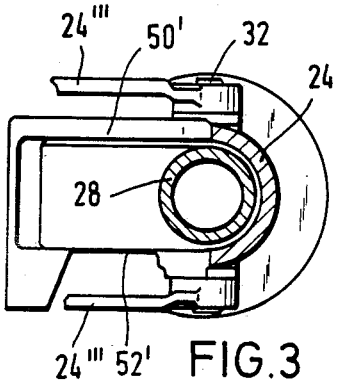
FIG. 3 is a sectional view seen along line III—III of FIG. 1 of the mortar and a swivel breech pivoted into the firing position.
Figure 4:
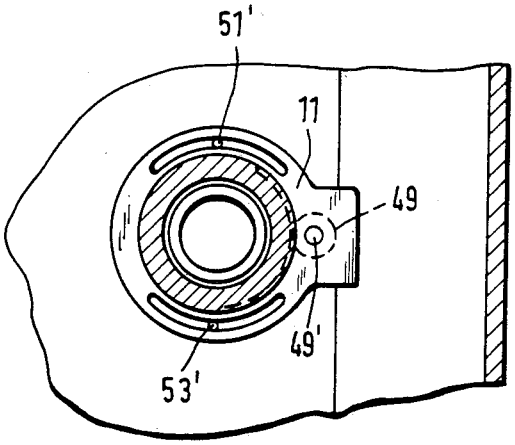
FIG. 4 is a sectional view seen along line IV—IV of FIG. 2 illustrating the operation of lateral, elevational and swivel breech device adjustments from the side of the vehicle.

Ring gears 50' and 52' have different radii of curvature with respect to axis 32' so that, within the possible elevational setting of the mortar, the swivel breech i.e., lower tube section 28, can pivot from the loading position back to the respective firing position. Ring gear 50' has a space in its interior region for the pivoting movement of lower tube section 28 (FIG. 3). By arranging shaft 32 and bearing 24''' and 50'' within the cut-out section of ball joint 30, mortar 19 can be adjusted in every elevational position over the pivoting range defined in FIG. 4 by guide slots 11'' and 11''' through which shafts 51' and 53' pass, and also separately adjusted in the lateral direction by means of lateral adjustment device 48.

Referring to FIG. 1, the mortar 19 is disposed in the firing position identified as "F1". To load it, the lower tube section 28 is pivoted in the direction of arrow 66 by means of the pivoting device 52, 52', 53 and 53' operated from the interior 14 until the bore axis 22 of the lower tube section 28 lies in the path 18 defined by a central plane of opening 16. This causes the tensioning device 39 (FIG. 2) to tension the firing pin spring 38 and cock the firing pin 34. From the interior 14, a unit of ammunition (not shown) is now inserted into the lower tube section 28 and the latter is pivoted in the direction of arrow 68 until it is again flush with the upper tube section 26 and forms a gas-tight seal by known means which need not be described in detail. By actuating the firing device, described in greater detail below, shot development is initiated.

Referring to FIGS. 5 to 8, the tensioning process and unlocking of firing pin 34 is effected automatically by the pivoting movement of lower tube portion 28 which forms the breech. During tensioning, firing pin spring 38 is pretensioned by means of a pretensioning lever 74 fastened to firing pin 34. Pretensioning lever 74 is guided by a lifting cam 77 formed by a groove 75 disposed in recess 31 of the ball joint 30, until a block 70, charged by a spring 71, and held in holders 72 at the cylinder of tensioning device 39, engages in a notch 69 of the firing pin and retains the latter until, in the firing position, block 70 contacts an abutment 73 also disposed in recess 31 and releases firing pin 34. In the firing position, pretensioning lever 74 snaps, under tension of spring 38, from position 78'' and moves beyond starting position 78' which it had occupied at the beginning of the tensioning of spring 38, and urges toward position 78 within a groove 76 of shaft 32 so that firing pin 34, after passing through the bores in axis 32 and ball joint 30, can initiate firing.

Referring again to FIGS. 1 and 2, lowering the barrel, as shown for example at "F2", is effected via the elevation adjusting device 50, 50' and 51, which is operated from the interior 14. The traversing device 48 is also operated from the interior 14 so that the operating personnel is afforded protection by the side wall 13, 13' and the upper cover 13''. By lowering the mortar into the firing position on the bottom surface 54, forces developed during firing are not introduced into the vehicle 10; consequently, the vehicle may be designed as a very light-weight vehicle. Lowering from the traveling position "T" into the firing position "F1" along a straight line over a range of 80° advantageously assures not only very quick taking of position and changing of position but also enables loading of the mortar 19 from the interior 14.

It will be understood that the above description of the present invention is susceptible to various modifications, changes and adaptations, and the same are intended to be comprehended within the meaning and range of equivalents of the appended claims.

What is claimed is:

1. A weapons system comprising:

(a) a vehicle having a body including a side wall provided with a lower recess and defining an overhang with respect to said recess;

(b) first and second wall portions attached to said body and defining an opening in the region of said lower recess, said opening being covered by said overhang to provide a covered loading passage for ammunition units;

(c) a mortar including an upper tube portion disposed outside said side wall, a lower tube portion having a lower region and a ball joint with a cut-out section disposed at said lower region, a plate containing a socket for receiving said ball joint, said ball joint being mounted in said ball socket for allowing said lower tube portion to be pivoted, axis means defining a horizontal axis pivotally mounted in the cut-out section of said ball joint, bearings disposed on both sides of said lower tube portion, a housing for at least partially enclosing said lower tube portion in a firing position of said lower tube portion and having one end connected to said upper tube portion and another end connected, within said ball joint and via said bearings, with said axis means;

(d) a lifting carriage including first and second members each being disposed at a respective one of said first and second wall portions and having pivot bearings fastened to said axis means, said first and second members defining a path which is disposed in said opening and which is slightly inwardly inclined with respect to said vehicle for guiding movement of said lower tube portion through said opening;

(e) a lifting means drivingly coupled to said carriage at said first wall portion for raising said mortar to a traveling position with respect to said vehicle and for lowering said mortar to a firing position with said plate resting on the ground in the vicinity of said vehicle;

(f) lateral adjusting means disposed at said second wall portion for engaging the second member of said lifting means for laterally adjusting said mortar, said lateral adjusting means being operable from within said vehicle;

(g) pivoting means including a first ring gear fixed to said lower tube portion, a first drive pinion operatively engaged with said first ring gear, and a first shaft mounted to said lifting carriage, drivingly connected to said first drive pinion and controllable from the interior of said vehicle for pivoting said lower tube portion between a loading position in which said lower tube portion is aligned with said opening for receiving an ammunition unit therethrough and a firing position in which said lower tube is aligned with said upper tube portion;

(h) elevation adjusting means including a second ring gear fixed to said housing, a second drive pinion operatively engaged with said second ring gear, and a second shaft mounted to the lifting carriage, drivingly connected to said second drive pinion and controllable from the interior of said vehicle for adjusting the elevation of said upper tube portion; and (i) firing means contained within said ball joint and including a firing pin and a tensioning means operatively connected with said firing pin, said tensioning means being responsive to a pivoting of said lower tube portion into the loading position for automatically being placed in a state of tension and responsive to a pivoting of said lower tube portion into the firing position for releasing the state of tension and urging the tensioning means against said firing pin.

2. Weapons system as defined in claim 1, wherein said axis means comprises a third shaft, said ball joint is provided with a recess, said tensioning means is connected with said third shaft in the recess of said ball joint and is arranged to provide an interior space in which said firing pin is disposed and for guiding movement of said firing pin within said interior space, said ball joint is further provided with a groove defining a lifting curve and said tensioning means further includes a firing pin spring and a pretensioning lever in operative relationship with said firing pin spring and connected to said firing pin, said pretensioning lever being disposed in said groove and arranged to be guided along said lifting curve from a first position obtained in the firing position of said lower tube portion after an ammunition unit is fired to a second position when said lower tube portion is pivoted into the loading position for urging said firing pin spring into a state of tension.

3. Weapons system as defined in claim 2, wherein said firing pin is provided with a notch and said firing means further includes an abutment disposed within the recess of said ball joint and a block fastened to said tensioning means, said block engaging said notch when said pretensioning lever is in the second position to secure said pretensioning lever, said third shaft having a groove for receiving said firing pin, said block contacting said abutment when said lower tube portion is pivoted to the firing position to release said block from said notch, causing said pretensioning lever to rapidly advance by a tension force presented by said firing pin spring urging said firing pin beyond the first position into the groove contained in said third shaft for initiating firing of said mortar.

4. A weapons system comprising:

a mortar including a dividable tube having an upper tube section and a lower tube section and means for pivotally mounting said lower tube section for movement about an essentially horizontal axis;

a vehicle having a body including a side wall provided with an opening, said mortar being mounted to said vehicle body on the exterior of said side wall, said side wall having a recessed region constructed for receiving said mortar, said lower tube section being movable about said horizontal axis between a loading position in which said lower tube section is aligned with the opening in said side wall for breech loading a projectile into said lower tube section from the interior of said vehicle and a firing position in which said lower tube section is aligned with said upper tube section;

means connected with said vehicle for mounting said mortar for movement between a traveling position in which said mortar is positioned to travel with said vehicle and a firing position in which said mortar is positioned to fire a projectile, said traveling position being delimited by the recessed region provided in said side wall for receiving said mortar and said firing position being located on the ground in the vicinity of said vehicle.

5. A weapons system according to claim 4, wherein said body is arranged around said opening to present a covered passage for loading a projectile into said mortar.

6. A weapons system according to claim 4, wherein said lower tube section has a lower end, and said pivotal mounting means includes: a ball joint disposed at said lower end, said horizontal axis traversing said ball joint; and a bottom plate provided with a ball socket disposed adjacent said lower end and receiving said ball joint.

7. A weapons system according to claim 6, wherein said ball joint is provided with a recess, and further comprising a firing pin extending into said recess and pretensioning means disposed in said recess for automatically pretensioning said firing pin when said lower tube section is moved to the loading position and for actuating said firing pin to initiate firing of a projectile when said lower tube section is moved to the firing position.

8. A weapons system according to claim 7, and further comprising an elevation adjusting means for adjusting the elevation of said mortar, and a lateral adjusting means for adjusting lateral movement of said mortar; wherein said elevation adjusting means, lateral adjusting means and said pivotal mounting means are all operable from the interior of said vehicle body.

9. A weapons system according to claim 4, wherein said vehicle body includes an overhang and said side wall is disposed in the region of said overhang.

10. A weapons system according to claim 9, wherein said side wall is the rear side wall of said vehicle.

11. A weapons system according to claim 9, and further comprising a bottom plate attached to the bottom end of said mortar tube, wherein in the firing position of the mortar said bottom plate rests on the ground in a region covered at least in part by said overhang.

12. A weapons system according to claim 4, wherein said vehicle is an armored vehicle.

* * * * *